US010352637B1

(12) United States Patent
Geissele et al.

(10) Patent No.: US 10,352,637 B1
(45) Date of Patent: Jul. 16, 2019

(54) BUFFER AND SPRING ASSEMBLY FOR A FIREARM

(71) Applicant: WHG Properties, LLC, North Wales, PA (US)

(72) Inventors: William H. Geissele, Lower Gwynedd, PA (US); Kerry Cannon, Oklahoma City, OK (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/394,067

(22) Filed: Apr. 25, 2019

Related U.S. Application Data

(63) Continuation of application No. 15/968,408, filed on May 1, 2018, now Pat. No. 10,317,152, which is a continuation of application No. 15/796,243, filed on Oct. 27, 2017, now Pat. No. 9,995,545, which is a continuation of application No. 14/837,981, filed on Aug. 27, 2015, now Pat. No. 9,829,260.

(60) Provisional application No. 62/209,588, filed on Aug. 25, 2015.

(51) Int. Cl.
*F41A 3/84* (2006.01)

(52) U.S. Cl.
CPC ..... *F41A 3/84* (2013.01)

(58) Field of Classification Search
CPC ..... F41A 3/84; F41A 3/78; F41A 3/80; F41A 3/82; F41A 3/86; F41A 3/88
USPC ..... 42/1.06
See application file for complete search history.

(56) References Cited

U.S. PATENT DOCUMENTS

| | | | | |
|---|---|---|---|---|
| 5,428,703 | A | 6/1995 | Lee | |
| 5,515,466 | A | 5/1996 | Lee | |
| 5,909,002 | A | 6/1999 | Atchisson | |
| 6,418,833 | B1 | 7/2002 | Hajjar | |
| 7,055,422 | B1 | 6/2006 | Dindl et al. | |
| 7,478,495 | B1 | 1/2009 | Alzamora et al. | |
| 8,210,090 | B2 | 7/2012 | Brown | |
| 8,468,729 | B1 | 6/2013 | Sylvester | |
| 8,689,380 | B2 | 4/2014 | Gladney et al. | |
| 2010/0251587 | A1* | 10/2010 | Kincel | F41A 3/84 42/1.06 |
| 2010/0251588 | A1 | 10/2010 | Kincel | |
| 2011/0263164 | A1 | 10/2011 | Lenhert et al. | |
| 2012/0297656 | A1 | 11/2012 | Langevin et al. | |
| 2013/0192114 | A1 | 8/2013 | Christenson | |
| 2014/0075798 | A1 | 3/2014 | Kincel | |
| 2014/0260946 | A1 | 9/2014 | Gomez | |

(Continued)

OTHER PUBLICATIONS

"MG-42 SA Owner's Manual Bell-Fed Semi-Automatic Rifle," Rev. 2 (Jan. 4, 2006).

*Primary Examiner* — Joshua E Freeman
(74) *Attorney, Agent, or Firm* — Fox Rothschild LLP

(57) ABSTRACT

The present disclosure provides a buffer kit or assembly for an AR-15, M16, M4 carbine, SR-25, AR-10 and LR-308 type firearm with enhanced fatigue resistance. The buffer assembly includes a weighted buffer, a spring, and a buffer tube. The spring is helically shaped and is formed from multiple wire strands. The stranded wire spring has a greater nominal wire diameter, in comparison to prior art single wire springs, and thus the stranded wire spring itself has a smaller internal diameter. The shoulder of the weighted buffer is provided with a reduced diameter to accommodate the smaller internal diameter of the stranded wire spring.

20 Claims, 8 Drawing Sheets

(56) References Cited

U.S. PATENT DOCUMENTS

| | | | | |
|---|---|---|---|---|
| 2014/0305016 | A1 | 10/2014 | Cusano | |
| 2015/0121736 | A1* | 5/2015 | Faifer | F41A 9/65<br>42/49.01 |
| 2015/0192380 | A1 | 7/2015 | Hilsabeck | |
| 2015/0345881 | A1 | 12/2015 | Irvin | |

* cited by examiner

BUFFER AND SPRING ASSEMBLY FOR A FIREARM

CROSS REFERENCE TO RELATED APPLICATIONS

This application is a continuation of U.S. patent application Ser. No. 15/968,408 filed May 1, 2018, which is a continuation of U.S. patent application Ser. No. 15/796,243 filed Oct. 27, 2017 (now U.S. Pat. No. 9,995,545), which is a continuation of U.S. patent application Ser. No. 14/837,981 filed Aug. 27, 2015 (now U.S. Pat. No. 9,829,260), which claims the benefit of priority to U.S. Provisional Patent Application No. 62/209,588 filed Aug. 25, 2015, the disclosures of all of which are hereby incorporated by reference in their entireties.

BACKGROUND

Buffer assemblies are commonly provided in firearms, such as rifles, and function both to reduce recoil and to assist in the reloading of cartridges into the chamber in an automatic or semi-automatic firearm. Typically, a buffer assembly in the firearm includes a buffer tube, a buffer spring, and a weighted buffer. The buffer spring is mounted onto the weighted buffer, both of which are positioned within the buffer tube. Once a round is fired by the firearm, the bolt carrier is thrust in a rearward direction by the force of the firing round. As a result, the buffer spring is compressed by this action and provides the necessary return force to return the bolt carrier in a forward action to pick up a new round and to load the round into the chamber. The action of the spring in the buffer assembly and the mass of the weighted buffer also function to reduce the recoil of the firearm by spreading the force of the fired round over a greater period of time. As the buffer assembly spring cycles every time a round is fired, the spring can be exposed to a high number of cycles, especially when used in fully automatic rifles. This high number of cycles can result in fatigue of the spring in which the free length of the spring shortens over time, and eventually to the point of not being able to satisfactorily perform the above noted functions. Others have attempted to improve fatigue resistance in buffer assembly springs through the use of various materials, geometries and specialized coatings.

SUMMARY

The present disclosure provides a buffer and spring assembly for a firearm, and in particular for AR-15, M16, M4 carbine, SR-25, AR-10 and LR-308 type rifles. In particular, the present disclosure provides a buffer assembly with enhanced fatigue resistance for this type of rifle. The buffer ans spring can be provided as separate unassembled parts in kit form, or can be provided as an assembly. The buffer assembly includes a weighted buffer, a spring, and a buffer tube, and can be mounted within the buttstock of the firearm. The weighted buffer is formed with a shoulder about which the spring is mounted, wherein the assembled buffer and spring are housed within the buffer tube. The spring is helically shaped and is formed from multiple wire strands, for example three wire strands. The buffer tube has a standard sized internal diameter while the stranded wire spring has a matching outside diameter. The stranded wire spring has a greater nominal wire diameter, in comparison to prior art single wire springs, and thus the stranded wire spring itself has a smaller internal diameter. The shoulder of the weighted buffer is provided with a reduced diameter to accommodate the smaller internal diameter of the stranded wire spring.

DETAILED DESCRIPTION

The present disclosure provides a fatigue resistant buffer assembly for a firearm, such as an AR-15, M16, M4 carbine, SR-25, AR-10 and LR-308 type rifle.

Figure 1:
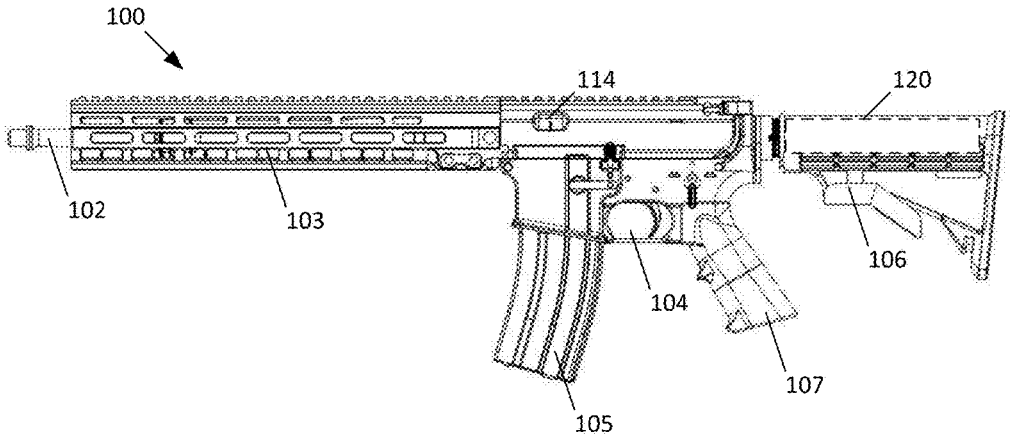
FIG. 1 is a right elevation view of a firearm having a buffer assembly according to a first embodiment of the present disclosure.
Figure 2:
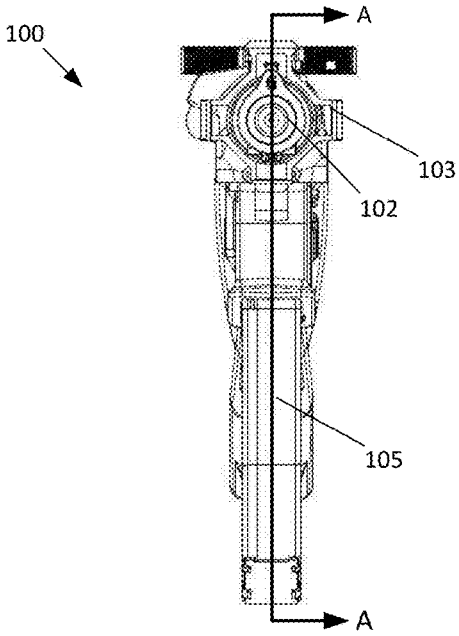
FIG. 2 is a front elevation view of the firearm of FIG. 1.

Referring to FIGS. 1 and 2, a firearm 100 is shown. In the particular embodiment depicted, the firearm 100 is an AR-15, M16, M4 carbine, SR-25, AR-10 and LR-308 type rifle having components including a barrel 102, hand guard 103, trigger assembly 104, magazine 105, a buttstock 106, a handle 107, and a chamber 114. FIG. 1 additionally schematically depicts a buffer assembly 120 located within the buttstock 106 of the firearm 100. An example of the buffer assembly 120 is illustrated and described in more detail herein, such as with reference to FIGS. 3-4.

Figure 3:
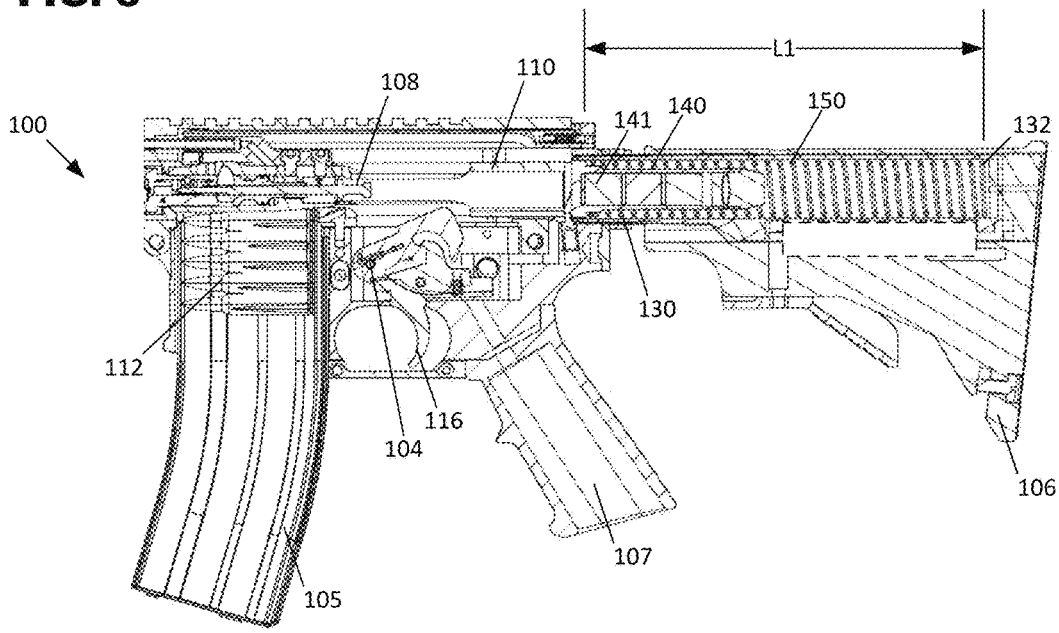
FIG. 3 is a cross-sectional view of the firearm of FIG. 1, taken along the line A-A in FIG. 2 with the buffer assembly in a compressed state.
Figure 4:
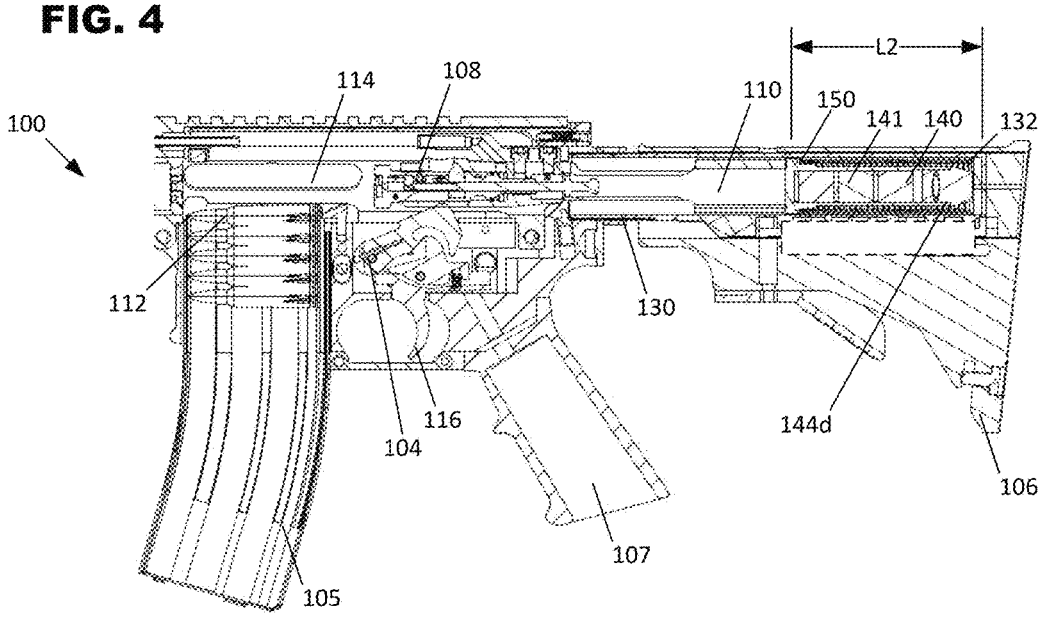
FIG. 4 is a cross-sectional view of the firearm of FIG. 1, taken along the line A-A in FIG. 2 with the buffer assembly in an expanded state.

FIGS. 3 and 4 show cross-sectional views of the internal components of the firearm 100, taken along the line A-A shown in FIG. 2. FIGS. 3 and 4 are the same, with the exception of the position of the internal components within the firearm, as explained herein. FIGS. 3 and 4 further detail that the firearm 100 includes a bolt carrier group 108 including a bolt 110. In generalized terms, the bolt 110 reciprocates within the firearm 100 in rearward and then a forward motion, and during the forward motion operates to strip the magazine 105 of a round 112 and to load the round 112 into a chamber 114 where it is once again ready for firing. FIG. 3 shows the bolt 110 in its most forward position. After firing, gases from the fired round force the bolt 110 into a rearward motion, causing the spent round to be ejected from the chamber 114 and the bolt 110 to be moved to its most rearward position. FIG. 4 shows the bolt 110 in this position. When the firearm 100 is an automatic firearm, the bolt 110 continuously cycles between these forward and rearward positions during an automatic firing mode of the firearm 100.

FIGS. 3 and 4 also show additional details of the buffer assembly 120, wherein it can be seen that the buffer assembly 120 is partially housed within the buttstock 106 and located directly behind the bolt 110. As shown, the buffer assembly 120 includes a buffer tube 130, a weighted buffer 140 having internal weights 141, and a buffer spring 150. The buffer tube 130 extends from the bolt carrier group 108 and into the buttstock 106. The buffer spring 150 and the weighted buffer 140 are mounted within the buffer tube 130, wherein buffer spring 150 is mounted at one end over the weighted buffer 140. As installed, the weighted buffer 140 is adjacent to and in contact with the bolt 110 while the opposite end of the buffer spring 150 is adjacent to and in contact with an end wall 132 of the buffer tube. In this arrangement, the buffer spring 150 forces the weighted buffer 140 against the bolt 110 to bias the bolt 110 into the forward position. The force of the spring 150 provides the necessary force to return the bolt 110 from the rearmost position after firing back forward to pick up and load a new round. This arrangement also functions to reduce the recoil of the firearm by spreading the force of the fired round over a greater period of time.

As can be seen at FIG. 3, the buffer spring 150, via the weighted buffer 140, has forced the bolt 110 into the forward most position, wherein the next round 112 (not visible in FIG. 3) is loaded into the chamber 114 and is ready for firing. It is noted that even in this position, the buffer spring 150 is compressed to a length L1 and does not extend to its full free length. In the embodiment shown, length L1 is about 6.74 inches.

As can be seen at FIG. 4, the buffer spring 150 and weighted buffer have been forced rearward by the movement of the bolt 110 into its rearward most position. In this position, a bumper 142 of the weighted buffer 140 is in contact with the end wall 132 of the buffer tube 130, with the buffer spring 150 being in a fully compressed state. In this position, the buffer spring 150 is compressed to a length L2. In the embodiment shown, length L2 is about 3.0 inches.

Figure 5:
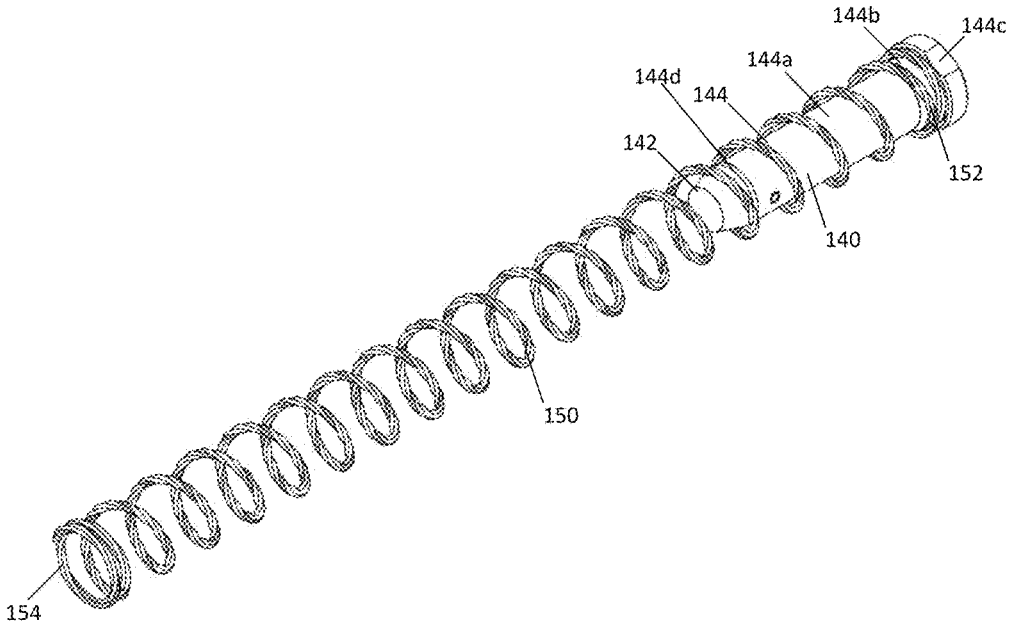
FIG. 5 is an isometric view of the buffer assembly of the firearm of FIG. 1.

Referring to FIG. 5, the assembly of the weighted buffer 140 and buffer spring 150 are shown in further detail. The weighted buffer 140 is shown as including a bumper 142, a buffer housing 144 defining a sleeve portion 144*a*, a shoulder portion 144*b*, and a collar portion 144*c*. The sleeve portion 144*a* of the buffer housing has an open end 144*d* that receives the weights 141 and the bumper 142. The bumper 142 is formed from a plastic or elastomeric material and acts as a stop for the weighted buffer 140 against the end wall 132 of the buffer tube 130. In the embodiment shown, the buffer housing 144 is provided as a single part in which the sleeve portion 144*a*, shoulder portion 144*b*, and collar portion 144*c* are integrally formed.

Figure 6:
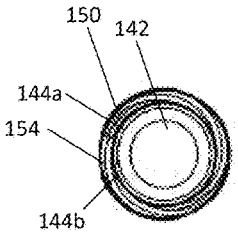
FIG. 6 is a front elevation view of the buffer assembly of FIG. 5.
Figure 7:
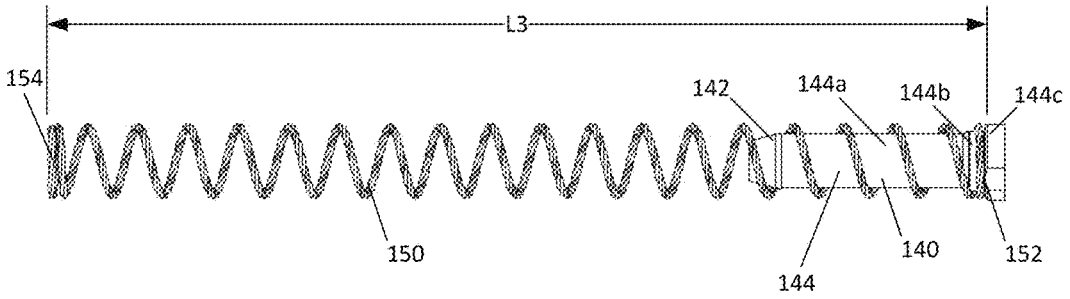
FIG. 7 is a right elevation view of the buffer assembly of FIG. 5.
Figure 8:
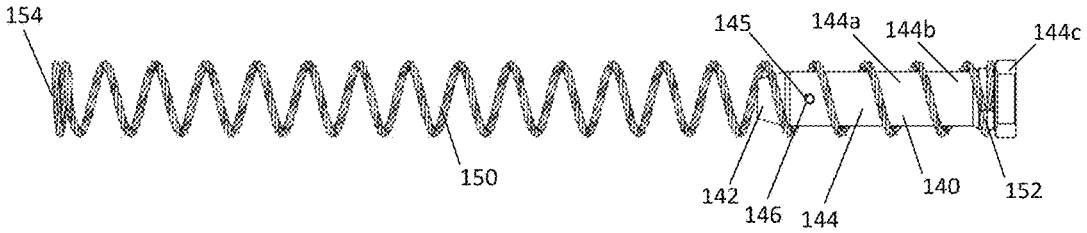
FIG. 8 is a top elevation view of the buffer assembly of FIG. 5.
Figure 9:
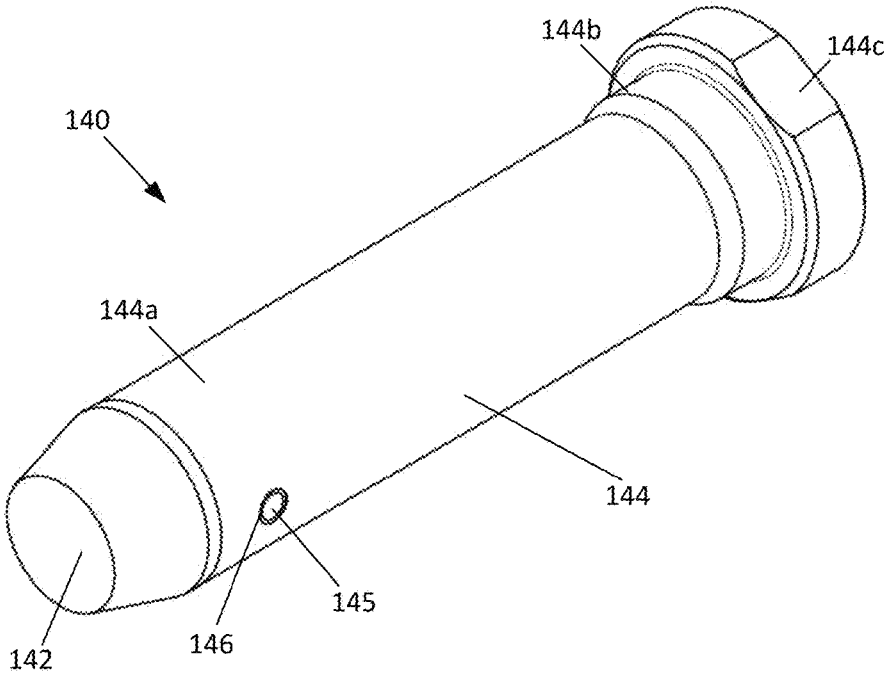
FIG. 9 is an isometric view of the buffer of the buffer assembly of the firearm of FIG. 1.
Figure 10:
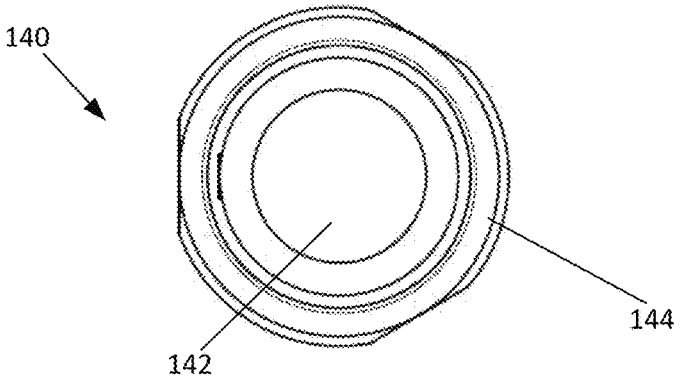
FIG. 10 is a front elevation view of the buffer of FIG. 9.
Figure 11:
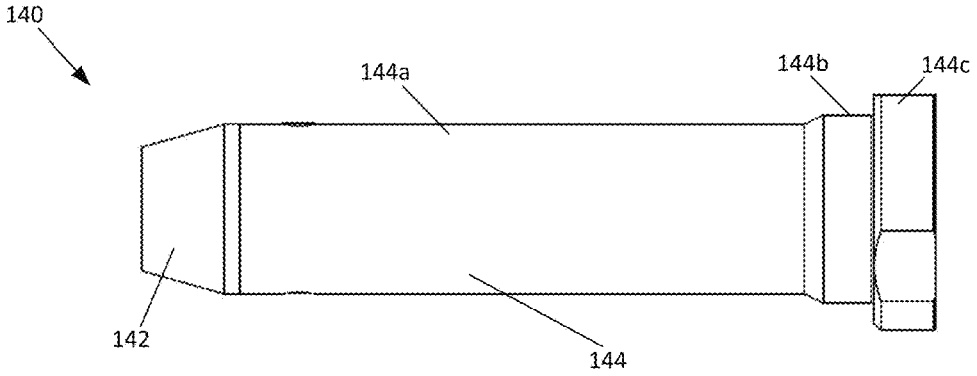
FIG. 11 is a right elevation view of the buffer of FIG. 9.

With continued reference to FIG. 5, the buffer spring 150 defines a first open end 152 and a second open end 154, wherein the weighted buffer 140 is inserted through the first open end 152 such that the collar portion 144*c* abuts the open end 152. As can be most easily seen at FIG. 6, the diameter of the sleeve portion 144*a* is less than the internal diameter of the spring 150, thus leaving a slight gap between the two components. In contrast, the shoulder portion 144*b* has an outside diameter of a dimension that ensures that direct contact exists between the spring 150 and the shoulder portion 144*b*. FIG. 7 shows a side view of the assembled spring 150 and weighted buffer 140, where it can be seen that the spring 150 has a free length L3. FIG. 8 shows a top view of the assembled spring 150 and weighted buffer 140, wherein it can be seen that the weighted buffer 140 further includes a pin 145 inserted through an aperture 146 in the sleeve portion 144*a* that secures the bumper 142 to the buffer housing 144.

Figure 12:
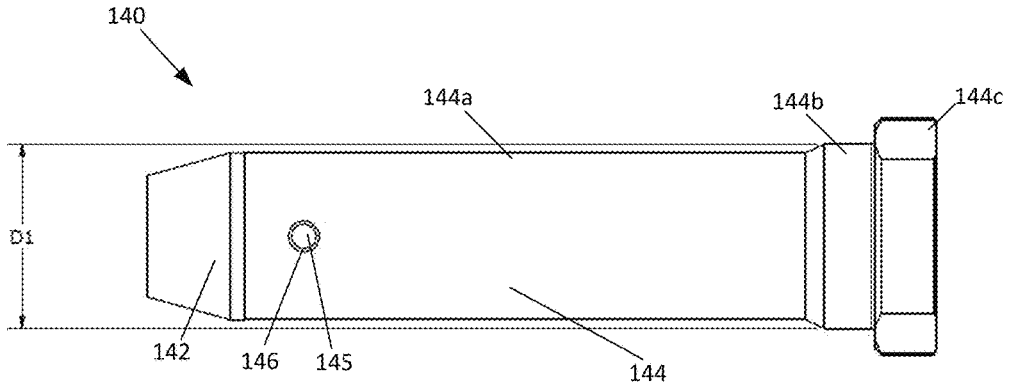
FIG. 12 is a top elevation view of the buffer of FIG. 9.

With reference to FIGS. 9-12, the weighted buffer 140 is shown in isolation such that the bumper 142, buffer housing 144, sleeve portion 144*a*, shoulder portion 144*b*, collar 144*c*, pin 145, and aperture 146 can be more clearly viewed. With reference to FIG. 12 specifically, it can be seen that the shoulder portion 144*b* of the buffer housing 144 is provided with an outside diameter D1. In the embodiment shown, diameter D1 is 0.76 inch. Notably, a standard buffer has a shoulder diameter of about 0.78 inch.

Figure 13:
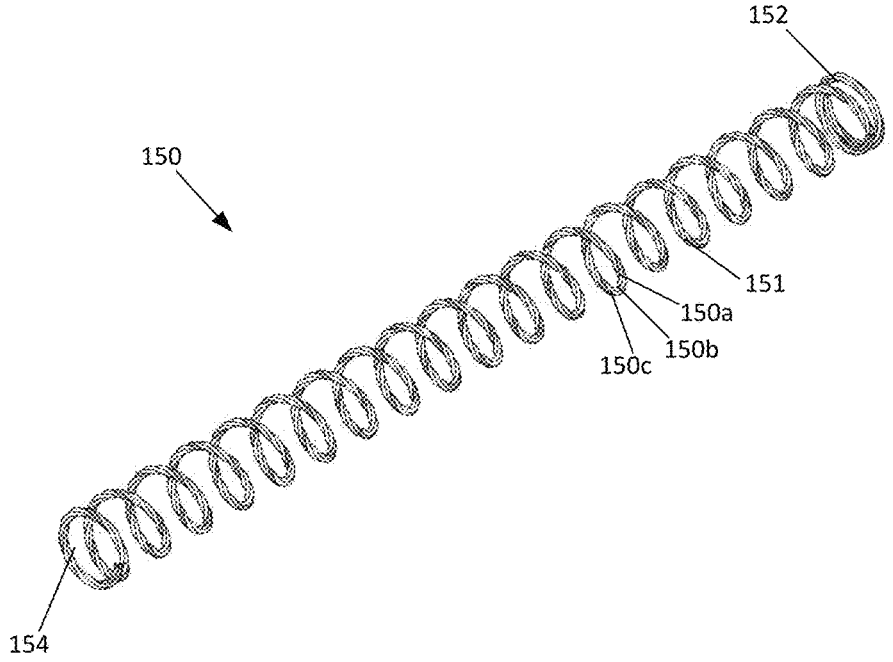
FIG. 13 is an isometric of the spring of the buffer assembly of the firearm of FIG. 1.

With reference to FIGS. 13-16, the buffer spring 150 is shown in isolation such that aspects of the buffer spring 150 can be shown in greater detail. FIG. 13 shows the first and second ends 152, 154 of the spring 150. FIG. 13 also shows that the buffer spring 150 is formed from three separate wire strands 150*a*, 150*b*, 150*c*. To form the buffer spring 150, the wire strands 150*a*, 150*b*, 150*c* are twisted together in the same fashion as a rope to form a wire strand 151 which is then wrapped about a mandrel to form a helical spring. In the embodiment shown, each of the wire strands 150*a*, 150*b*, 150*c* is a steel wire, for example 0.045 inch diameter steel music wire. Although a stranded wire 151 formed from three wire strands is shown, fewer or more wires may be used to form the stranded wire 151, for example, two, four, five, six, or more wires. Additionally, other types of materials can be used for the wire strands, such as heat treated chrome silicon wirestock. In one aspect, the wires strands 150*a*, 150*b*, 150*c* can be twisted together to form 1.9 to 2.3 twists per inch or to have a twist pitch (distance between a common point on adjacent braids) of between about 0.43 inch and 0.52 inch. In one embodiment, the wire strand has a twist pitch of 0.475 inch or is formed to have 2.1 twists per inch.

Figure 14:
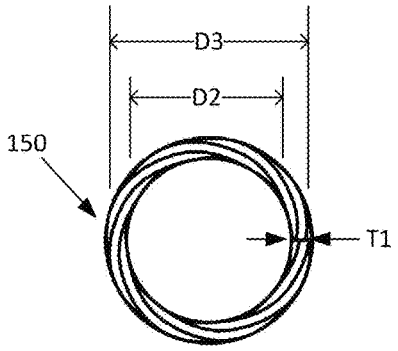
FIG. 14 is a front elevation view of the spring of FIG. 13.

FIG. 14 shows that the buffer spring 150 has an internal diameter D2 and an outside diameter D3. FIG. 14 also shows that the stranded wire 151 that forms the spring 150 has a nominal thickness T1. In one aspect, the buffer spring 150 is provided with an outside diameter D3 of 0.95 inch that is generally equivalent to the outside diameter of a typical prior art buffer spring. The nominal thickness T1 of the stranded wire 151 is about 0.184 inch, resulting in an internal spring diameter D2 of 0.756. The nominal thickness T1 of the stranded wire is relatively greater than the typical diameter of a standard prior art buffer wire. As the outside diameter D3 of the stranded wire is matched to be the same as the outside diameter of a standard buffer wire, the internal diameter D3 of the stranded wire spring is less than the internal diameter of a standard wire spring. To accommodate this smaller internal diameter, the outside diameter D1 of the weighted buffer shoulder portion 144*b* has a reduced diameter in comparison to a standard prior art buffer. However, the shoulder portion 144*b* outside diameter D1 is still provided at a dimension that is slightly larger than the internal diameter D3 of the buffer spring 150 in order to provide for a slight interference fit.

Figure 15:
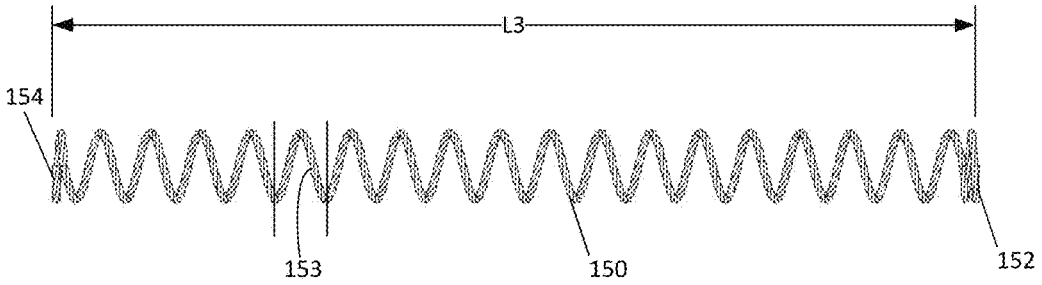
FIG. 15 is a right elevation view of the spring of FIG. 13.

FIG. 15 shows the buffer spring 150 in a relaxed state such that the spring 150 extends to its full free length L1. FIG. 15 also shows that the buffer spring 150 includes a number of coils 153 extending between the first and second ends 152, 154 of the spring 150. In the particular embodiment shown, the spring 150 is provided with 20 total coils with 18 of the coils being fully active. The fully active coils are those coils which are expanded when the spring 150 is at its free length and which can be compressed together as the spring 150 is compressed. It is noted that more or fewer active coils can be provided without departing from the concepts presented herein.

Figure 16:
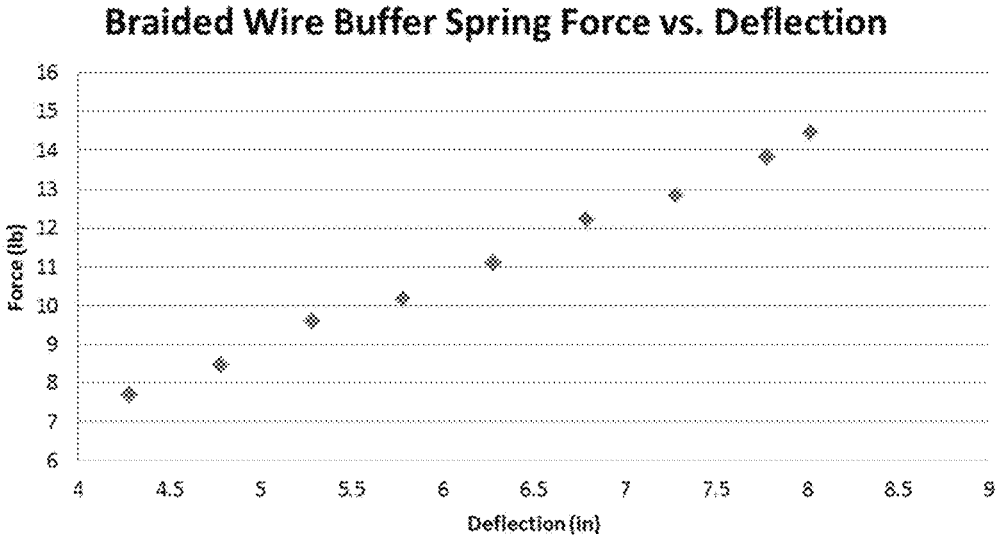
FIG. 16 is a force-deflection graph for the buffer spring of FIG. 13.

Referring to FIG. 16, a force-deflection graph is shown for the buffer spring 150 in one particularly useful example. The force-deflection graph at FIG. 16 shows deflection in inches in comparison to pounds force on the buffer spring 150, and shows the buffer spring 150 as having a relatively constant spring rate of about 1.78 pounds per inch. Additionally, the spring 150 has a compressed force of 7.24 pounds when compressed to a length L1 of 6.74 inches and a compressed force of 14.25 pounds when fully compressed to a length L2 of 3.0 inches. In this example, the buffer spring 150 has a free length of 11 inches and 24.5 active coils, and is formed from three strands of 0.045 inch diameter wire with a twist pitch of about 0.475 inch, wherein the strands are each made from a steel music wire material. By careful consideration of each of these design variables, the applicants have developed a stranded wire buffer spring 150 that can be used in a firearm 100 with exceptional performance and fatigue resistance.

Notably, prior art based calculation and modeling systems indicate that a stranded wire spring in a buffer spring application would not work in an AR-45, M16, M4 carbine, SR-25, AR-10 and LR-308 type of application. However, the inventors of this application have developed the above disclosed stranded wire spring 150 which does in fact operate successfully in this type of firearm 100. Additionally, an anticipated advantage of using a stranded wire spring for the buffer spring 150 is enhanced resistance to fatigue stresses and increased cycle life. It is believed that this increased performance is due to the stranded wire spring having improved dampening characteristics over single wire springs and being less affected by high frequency vibration waves caused by firing rounds. Another advantage of using a stranded wire 151 formed from three separate wire strands 150*a*, 150*b*, 150*c* is that some measure of redundancy is provided as the buffer spring 150 will be at least partially operable with the breakage of one of the wire strands 150*a*, 150*b*, 150*c*.

Although specific examples are provided above, it is noted that the above identified performance characteristics can be accomplished through other combinations of spring characteristics. However, it has been found that these characteristics are generally bound within certain ranges for successful operation of the buffer assembly 120, for example a free length L3 of between 8.5 inches and 12.5 inches; a number of active coils between 20 and 40; an initial compression force at length L2 of between 6 pounds and 9 pounds; a compressed force at length L1 of between 11 pounds and 17 pounds; and a wire diameter of between 0.042 inch and 0.052 inch for each wire in the stranded wire 151.

What is claimed is:

1. A buffer and spring kit for a firearm comprising:

(a) a buffer including a buffer housing defining a sleeve portion, a collar portion, and a shoulder portion, wherein the shoulder portion has a first diameter and the sleeve portion has a second diameter smaller than the first diameter, the shoulder portion being located between the sleeve portion and the collar portion; and (b) a helical spring extending between a first end and a second end, the helical spring being configured for mounting to the buffer such that the sleeve portion and the shoulder portion can extend within an interior space defined by the helical spring with the first end abutting the collar portion and with the helical spring being in direct contact with the shoulder portion;

wherein the helical spring comprises at least three strands of wire that are twisted together to form the helical spring; and wherein the helical spring is configured to interface with a bolt of a firearm and is constructed to provide sufficient force to return the bolt from a rearmost position to a forward position after the firearm is fired.

2. The buffer and spring kit of claim 1, wherein the strands of wire include at least one first wire strand and a at least one second wire strand formed from the same material.

3. The buffer and spring kit of claim 2, wherein the at least one first and the at least one second wire strands are each formed from steel wire.

4. The buffer and spring kit of claim 1, wherein the buffer shoulder portion first diameter is less than 0.78 inch.

5. The buffer and spring kit of claim 4, wherein the helical spring defines a first internal diameter of 0.756 inch.

6. The buffer and spring kit of claim 1, wherein the helical spring defines an internal diameter that is less than the buffer shoulder portion first diameter.

7. The buffer and spring kit of claim 1, wherein the buffer and spring assembly is configured for installation in at least one of an AR-15, M16, M4 carbine, SR-25, AR-10 and LR-308 type rifle.

8. The buffer and spring kit of claim 1, wherein at least two of the strands of wire are formed from 0.045 inch diameter wire.

9. The buffer and spring kit of claim 1, wherein the helical spring has a constant spring rate of 1.78 pounds per inch.

10. The buffer and spring kit of claim 1, wherein the strands of wire have a twist pitch of between about 0.43 and 0.52 inch.

11. A buffer and spring assembly for a firearm comprising:

(a) a buffer including a buffer housing defining a sleeve portion, a collar portion, and a shoulder portion, wherein the shoulder portion has a first diameter and the sleeve portion has a second diameter smaller than the first diameter, the shoulder portion being located between the sleeve portion and the collar portion; and (b) a helical spring extending between a first end and a second end, the helical spring being mounted to the buffer such that the sleeve portion and the shoulder portion are within an interior space defined by the helical spring and the first end abuts the collar portion, and such that the helical spring is in direct contact with the shoulder portion;

wherein the helical spring comprises at least three strands of wire that are twisted together to form the helical spring; and wherein the helical spring is configured to interface with a bolt of a firearm and is constructed to provide sufficient force to return the bolt from a rearmost position to a forward position after the firearm is fired.

12. The buffer and spring assembly of claim 11, wherein the strands of wire include at least one first wire strand and a at least one second wire strand formed from the same material.

13. The buffer and spring assembly of claim 12, wherein the at least one first and the at least one second wire strands are each formed from steel wire.

14. The buffer and spring assembly of claim 11, wherein the buffer shoulder portion first diameter is less than 0.78 inch.

15. The buffer and spring assembly of claim 11, wherein the helical spring defines an internal diameter that is less than the buffer shoulder portion first diameter.

16. The buffer and spring assembly of claim 11, wherein the buffer and spring assembly is configured for installation in at least one of an AR-15, M16, M4 carbine, SR-25, AR-10 and LR-308 type rifle.

17. The buffer and spring assembly of claim 11, wherein the helical spring includes about 20 to 26.5 active coils.

18. The buffer and spring assembly kit of claim 11, wherein the helical spring has a free length of 8.5 to 12.5 inches.

19. The buffer and spring assembly of claim 11, wherein the helical spring includes 20 to 40 active coils.

20. A firearm comprising the buffer and spring assembly of claim 11.

* * * * *